US008397365B2

(12) United States Patent
Montgomery

(10) Patent No.: US 8,397,365 B2
(45) Date of Patent: Mar. 19, 2013

(54) RACK DISASSEMBLY TOOL

(75) Inventor: Colin Montgomery, Oliver (CA)

(73) Assignee: Rackmate Industries Inc., Oliver, British Columbia (CA)

( * ) Notice: Subject to any disclaimer, the term of this patent is extended or adjusted under 35 U.S.C. 154(b) by 443 days.

(21) Appl. No.: 12/801,884

(22) Filed: Jun. 30, 2010

(65) Prior Publication Data

US 2011/0083311 A1 Apr. 14, 2011

Related U.S. Application Data

(60) Provisional application No. 61/213,660, filed on Jun. 30, 2009.

(51) Int. Cl.
*A47F 5/00* (2006.01)
*B25C 3/00* (2006.01)

(52) U.S. Cl. ..... 29/402.03; 29/402.08; 29/426.1; 29/700; 29/257; 29/276; 269/3; 269/6; 269/143; 269/249

(58) Field of Classification Search ..... 29/257, 29/276, 402.03, 402.08, 426.1, 700, 897, 29/897.31, 897.312, 897.33, 897.35; 269/3, 269/6, 143, 249
See application file for complete search history.

(56) References Cited

U.S. PATENT DOCUMENTS

| | | | | |
|---|---|---|---|---|
| 4,730,386 | A * | 3/1988 | Fieberg et al. | 29/758 |
| 5,265,854 | A * | 11/1993 | Whiteford | 269/3 |
| 6,272,951 | B1 * | 8/2001 | Lambson | 81/44 |
| 2004/0075205 | A1 * | 4/2004 | Marks | 269/6 |
| 2009/0084746 | A1 * | 4/2009 | Rioux | 211/183 |

* cited by examiner

*Primary Examiner* — Derris Banks
*Assistant Examiner* — Anthony Green
(74) *Attorney, Agent, or Firm* — Antony C. Edwards

(57) ABSTRACT

A rack disassembly tool includes a substantially planar U-shaped collar having a pair of legs extending from a base. A pair of hook members depend downwardly from the distal ends of the pair of legs. A pair of resilient bumpers, or other resilient pads, are mounted in a corresponding pair of elbows formed at junctions between the pair of legs and the pair of hook members.

1 Claim, 16 Drawing Sheets

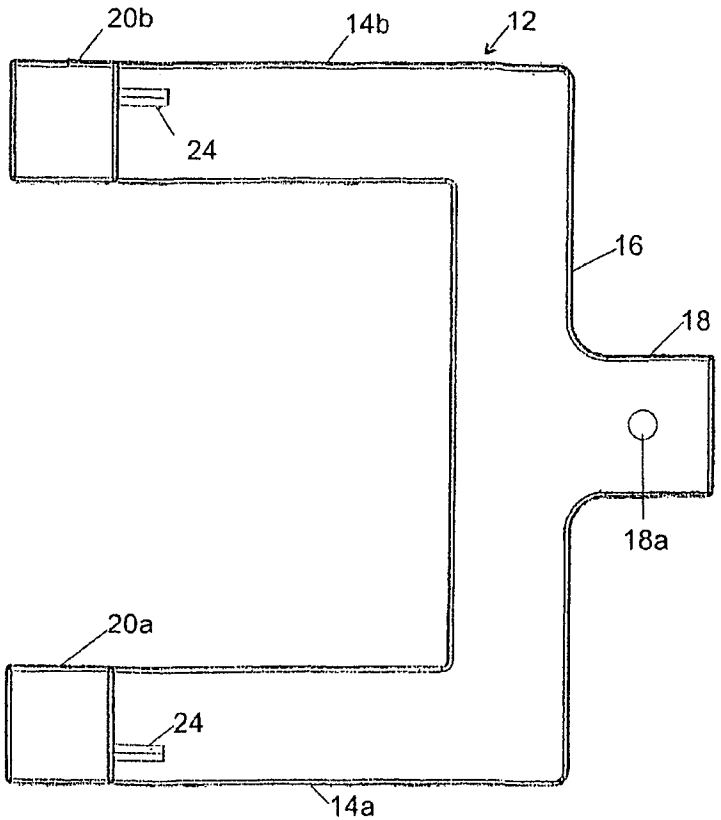
Fig 2
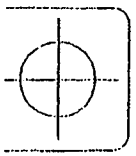
25.0

96" nominal
32
28
312" (26" – 0") nominal
30
30
30
30
30
4" boxbeam shown
28
3 1/16"

2"
28
28a
28c
2"
28b
4"
4"
42" nominal

3"
28
28a
48"
42"
42"
42"
42"
42"
42"
6"
28c
3"
28b
5"
5"
42" nominal

RACK DISASSEMBLY TOOL

CROSS REFERENCE TO RELATED APPLICATION

This application claims priority from U.S. Provisional Patent Application No. 61/213,660 filed Jun. 30, 2009 entitled Rack Disassembly Tool.

FIELD OF THE INVENTION

This invention relates to the field of warehouse racking systems and in particular to a rack disassembly tool for assisting with the replacement of damaged uprights in rack frames in warehouses, factories and the like.

BACKGROUND OF THE INVENTION

A large percentage of warehouses and factories maintain racking systems of one kind or another, and in particular maintain pallet racking systems. Typically, such racking systems may employ vertical trusses of linear upright members, herein collectively referred to as uprights, which interlock with orthogonal horizontal cross-beams, herein referred to as beams, so as to form a rack frame for supporting shelves, pallets and the like. Such uprights may weigh in the order of 500 pounds.

In the environment of a warehouse or factory, forklifts are often used to elevate pallets of goods and to place the pallets into the racking system. Occasionally, the forklifts collide with the racking system and in particular the uprights thereby resulting in damage to the uprights and in particular to the upright members exposed at the front of the rack. As will be appreciated by one skilled in the art, a damaged upright must be replaced rather than risk the load bearing capabilities of the damaged upright being compromised. A compromised upright may, when loaded, collapse causing a failure of the racking system.

In applicant's experience, typically when uprights are to be replaced in a racking system, or when the racking system requires adjustment, inexperienced employees may be contracted to complete the work. Applicant has observed that such workers may take two-three hours to replace a single upright.

Consequently there exists a need in the prior art for, and it is an object of the present invention to provide, a tool for use when replacing uprights in pallet racking systems so as to make replacement of damaged uprights more efficient to thereby reduce the man-hours required to change out an upright are thereby reduced. The tool may also assist in reducing the number of accidents incurred while working on upright change outs, for example, in situations where the uprights, once unsecured from the racking system, workers have been known to fall and be injured attempting to repair the racking system.

There is also a need in the prior art for, and it is one object of the present invention to provide, a rack disassembly tool which will be fit for use on most if not all of conventional widely-used pallet racking systems commonly known in that art, for example, those racking systems sold under the trademarks Speedrack™, Rigurack™, Teardrop™, Unarco II™, Structural™, Paltier™, Keystone™, and Sturdibuilt™. It is an object that the rack disassembly tool according to the present invention cooperate with such pallet racking systems to assist in the change out of damaged uprights or in the adjustment of the racking system without any modifications to the racking systems being required in order that the tool be successfully employed.

SUMMARY OF THE INVENTION

In summary the rack disassembly tool according to the present invention may be characterized in one aspect as including a substantially planar U-shaped collar having a pair of legs extending from a base, wherein the pair of legs have distal ends distal to the base. A pair of hook member depend downwardly from the distal end of the pair of legs. A pair of resilient pads, which may take the form of bumpers or other resilient padding, are mounted in a corresponding pair of elbows formed at junctions between the pair of legs and the pair of hook members.

Advantageously the pair of legs are oriented substantially orthogonally to the base. Each leg of the pair of legs and the base may be a substantially linear member.

In one embodiment of the pair of legs and the base is a substantially linear member. Each leg and the base may be of substantially equal length so as to form a substantially square-form collar. Advantageously the pair of hook members are substantially orthogonal to the pair of legs. In one embodiment each hook member may substantially linear or may be formed as a recti-linear block.

In a further aspect of the present invention also includes a method for disassembling a racking system so as to remove a damaged upright or adjust an upright. The method is employed on racking system, which include an array of laterally spaced apart vertical uprights supporting, interleaved therebetween, horizontal rows of cross beams, wherein the cross beams are mounted to the uprights by hooks on the end of the cross beams mating down into corresponding apertures in the uprights.

The method includes the steps of:

a) providing a rack disassembly tool according to the present invention;

b) mounting one of the tools at each junction of a cross beam and upright on each upright of a pair of uprights on either side of the damaged upright (that is, the upright to be removed or adjusted) by hooking the pair of hooked members behind the cross beam with the pair of legs straddling the upright so as to cross the base horizontally and snugly across the upright with the resilient pads sandwiched between the pair of hooked members and the corresponding cross beams;

c) un-hooking the cross beams from the damaged upright and allowing the cross beams to pivot about the uprights on either side thereof so as to swing the cross beams outwardly of the racking system, thereby allowing access to the damaged upright wherein the swing of the cross beams is under the resilient outwardly urging of the resilient pads acting on the cross beams;

d) replacing the damaged upright and/or adjusting an upright once disconnected from and between the ends of the outwardly pivoting cross beams.

BRIEF DESCRIPTION OF THE DRAWINGS

In the accompanying drawings wherein similar characters of reference denote corresponding parts in each view, and wherein dimensions in the illustrations are shown in millimetres but are not intended to be limiting but rather merely one example of one embodiment of the present invention:

FIG. 2 is, in bottom view, the tool of FIG. 1, with the bumpers removed.

DETAILED DESCRIPTION OF EMBODIMENTS OF THE INVENTION

Figure 1:
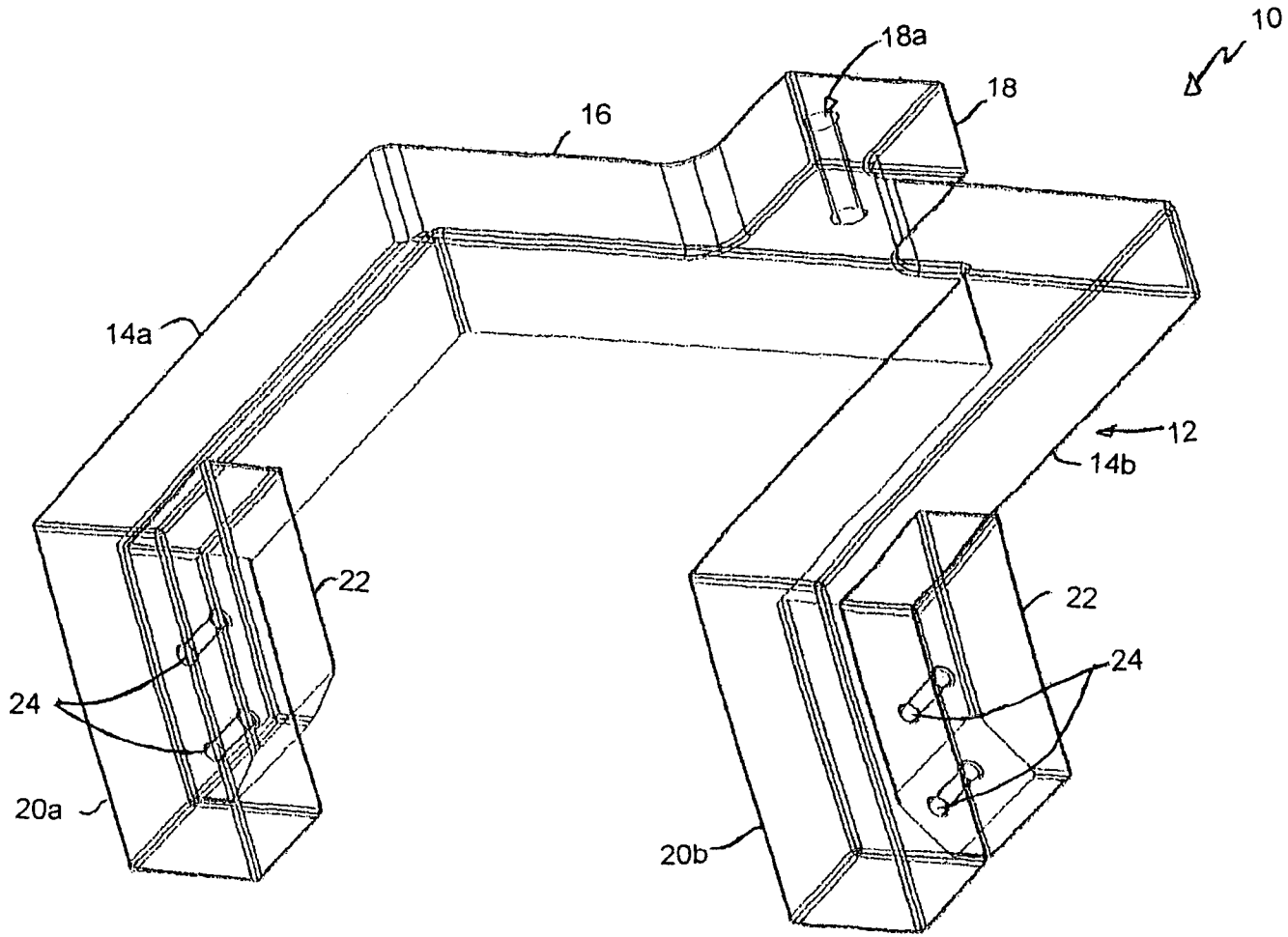
FIG. 1 is, in bottom front perspective view, one embodiment of the rack disassembly tool according to the present invention.
Figure 1A:
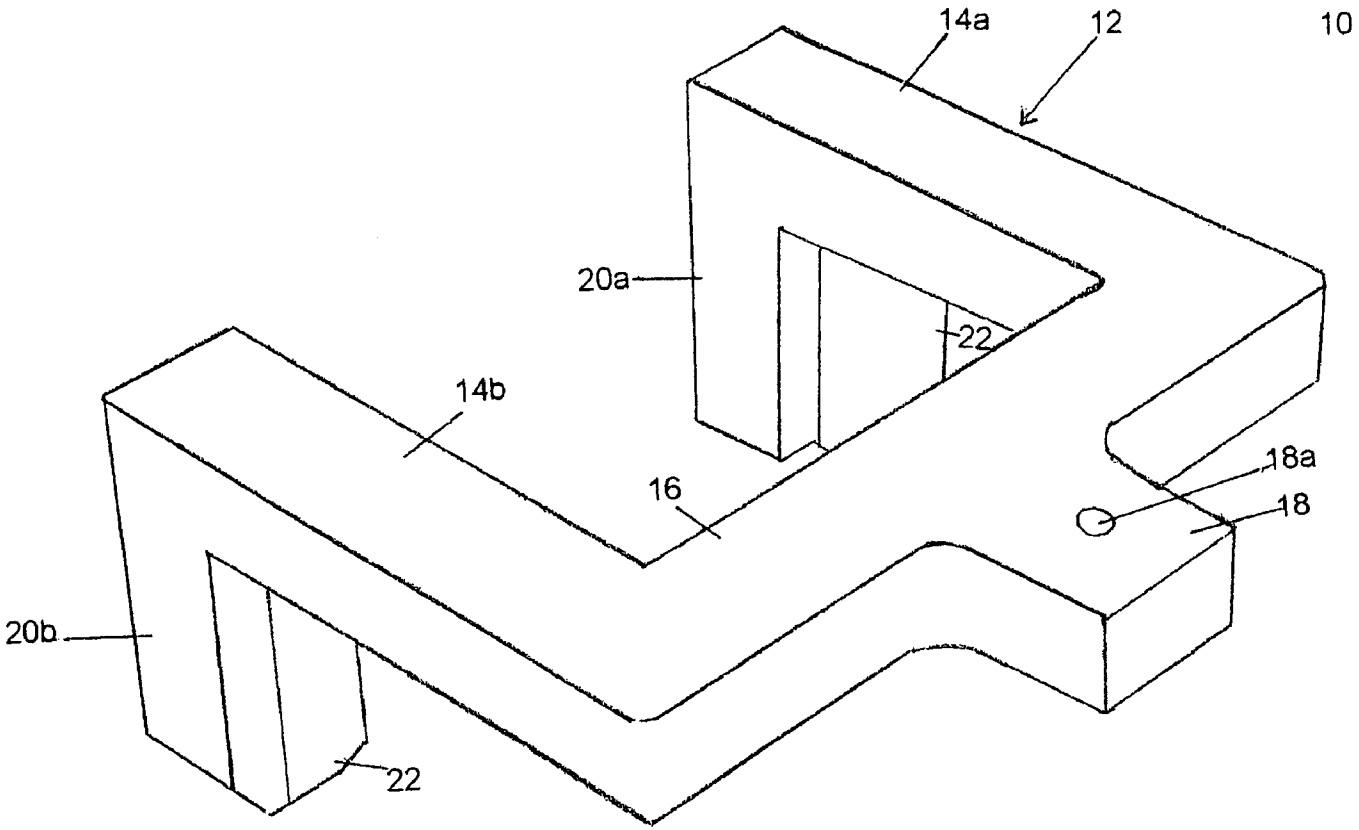
FIG. 1*a* is, in top front perspective view, the tool of FIG. 1.
Figure 3:
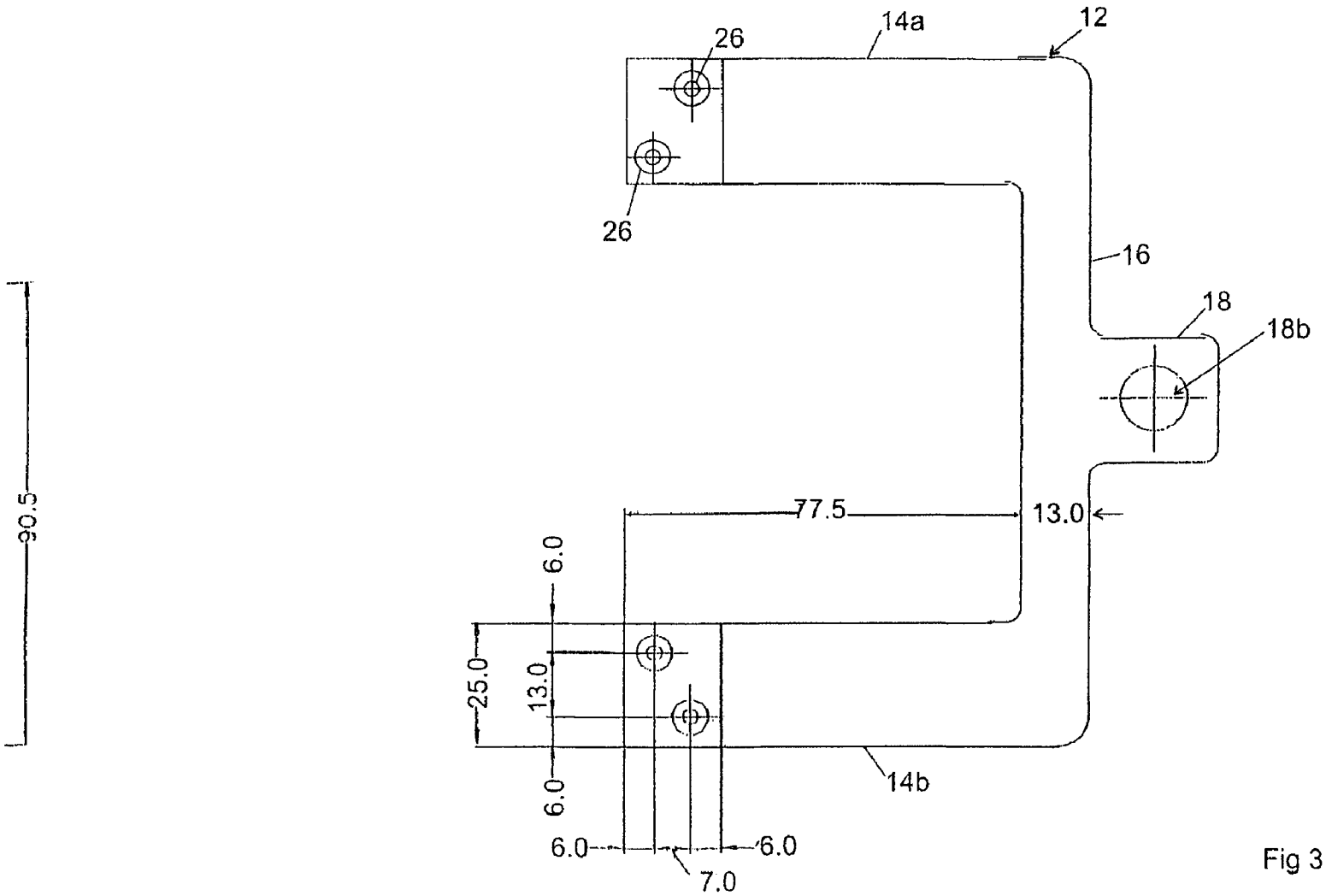
FIG. 3 is, in plan view, the tool of the FIG. 1.
Figure 4:
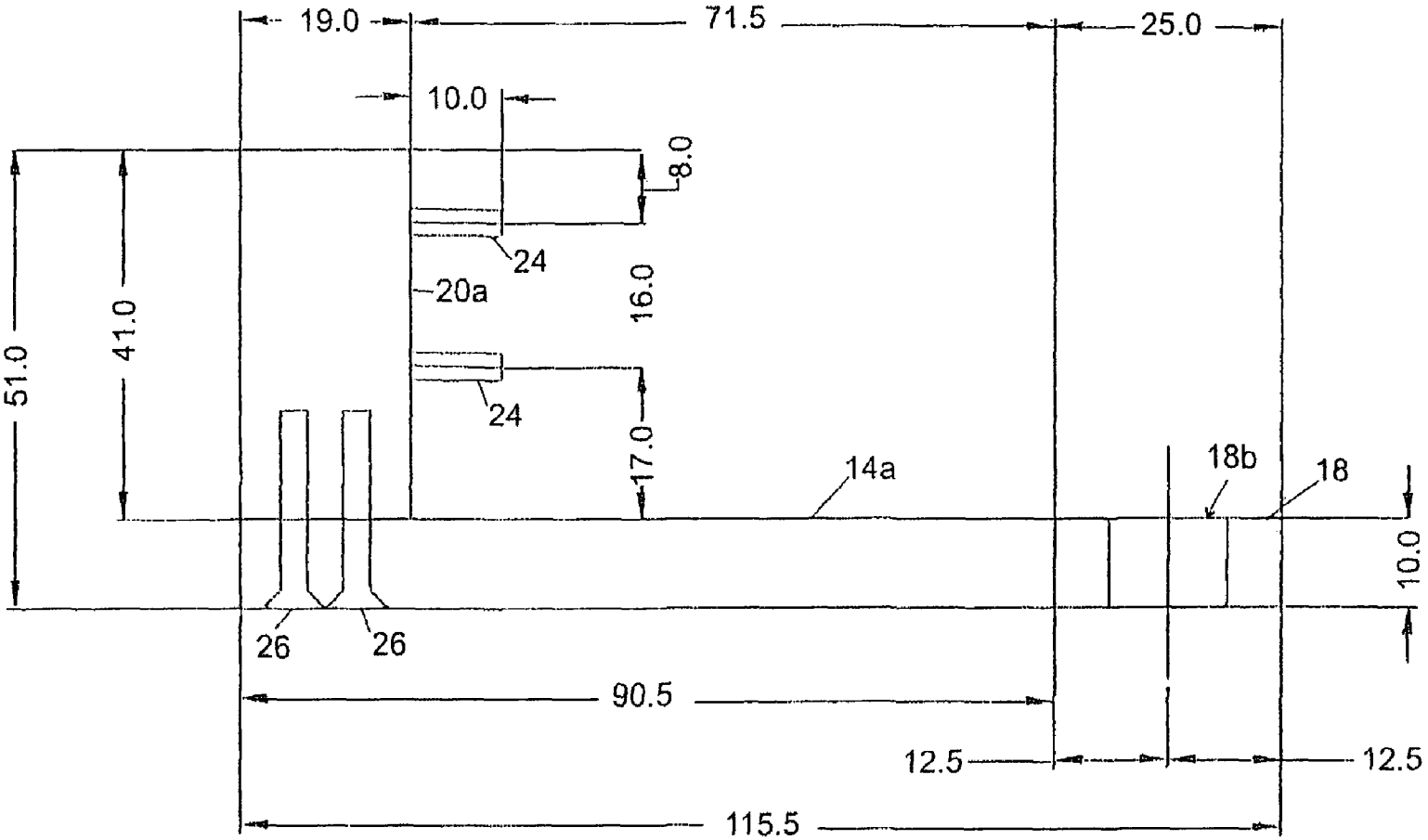
FIG. 4 is a right side elevation view of the tool of FIG. 1, with the bumpers removed, the left side elevation view (not shown) being a mirror image.
Figure 5:
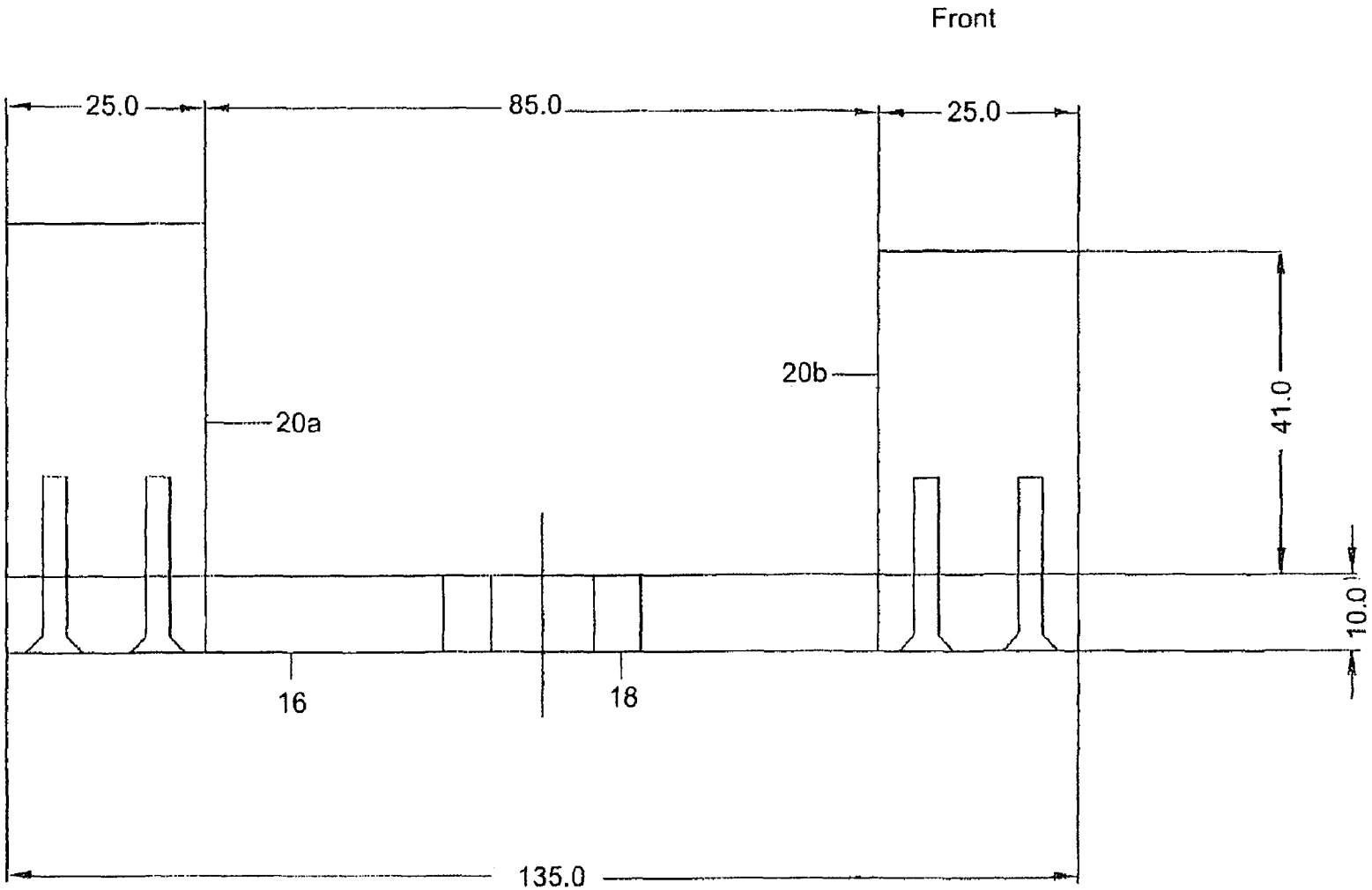
FIG. 5 is, in front elevation view, the tool of FIG. 1.
Figure 6:
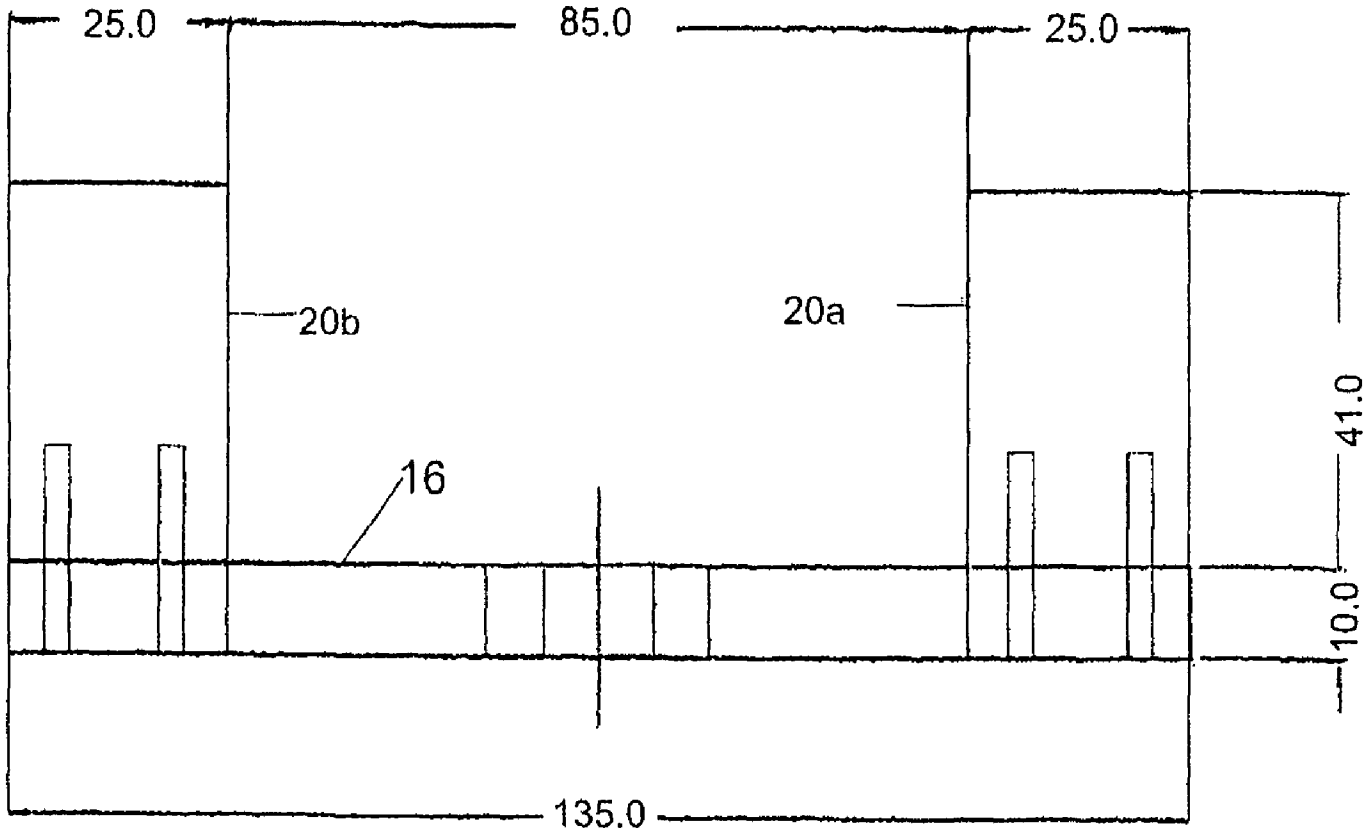
FIG. 6 is, in rear view, the tool of FIG. 1.
Figure 7:
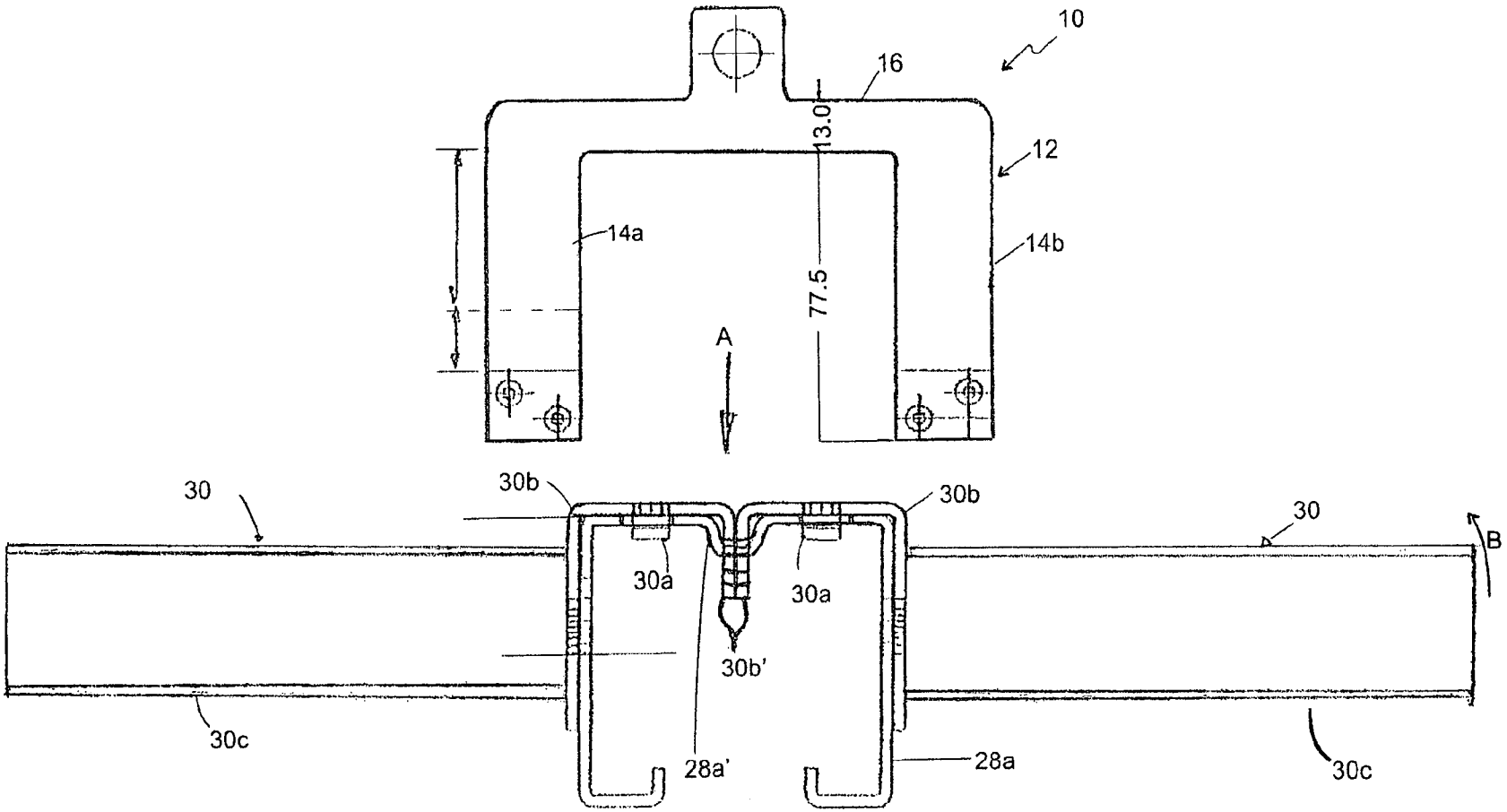
FIG. 7 is, in plan view, the tool of FIG. 3 being assembled onto a racking system, and in particular onto a beam where the beam abuts an upright member during the disassembly of the beam from the upright.

Rack disassembly tool 10 includes a substantially planar U-shaped collar 12 having parallel pair of legs 14*a* and 14*b* rigidly mounted to, so as to extend cantilevered from, the opposite ends of a base member 16. In one embodiment, not intended to be limiting, a boss 18 extends from the center of base member 16, oppositely disposed to legs 14*a* and 14*b*. Apertures 18*a* or 18*b* may be formed through boss 18. The apertures are for ease of carrying of the tools, for example, by a belt-mounted hook or clip. Boss 18 may be in the form of a tab which a worker may hit when the tool is installed, to release and remove the food from an upright. The installation of the tool is better described below.

A parallel pair of rigid hook members 20*a* and 20*b* extend downwardly and substantially orthogonally from the distal ends of legs 14*a* and 14*b*. The distal ends of legs 14*a* and 14*b* are opposite to base member 16.

Resilient bumpers 22, for example made of rubber or like resilient compounds, are mounted by means of fasteners 24, which may be pins, screws, bolts or the like, to hook members 20*a* and 20*b* so as to dispose bumper 22 underneath legs 14*a* and 14*b* snugged up under the legs and against the hook members. Hook members 20*a* and 20*b* may be formed as unitary components unitary with corresponding legs 14*a* and 14*b*, or may be separate rigid members mounted to legs 14*a* and 14*b* for example by means of fasteners 26.

Figure 8:
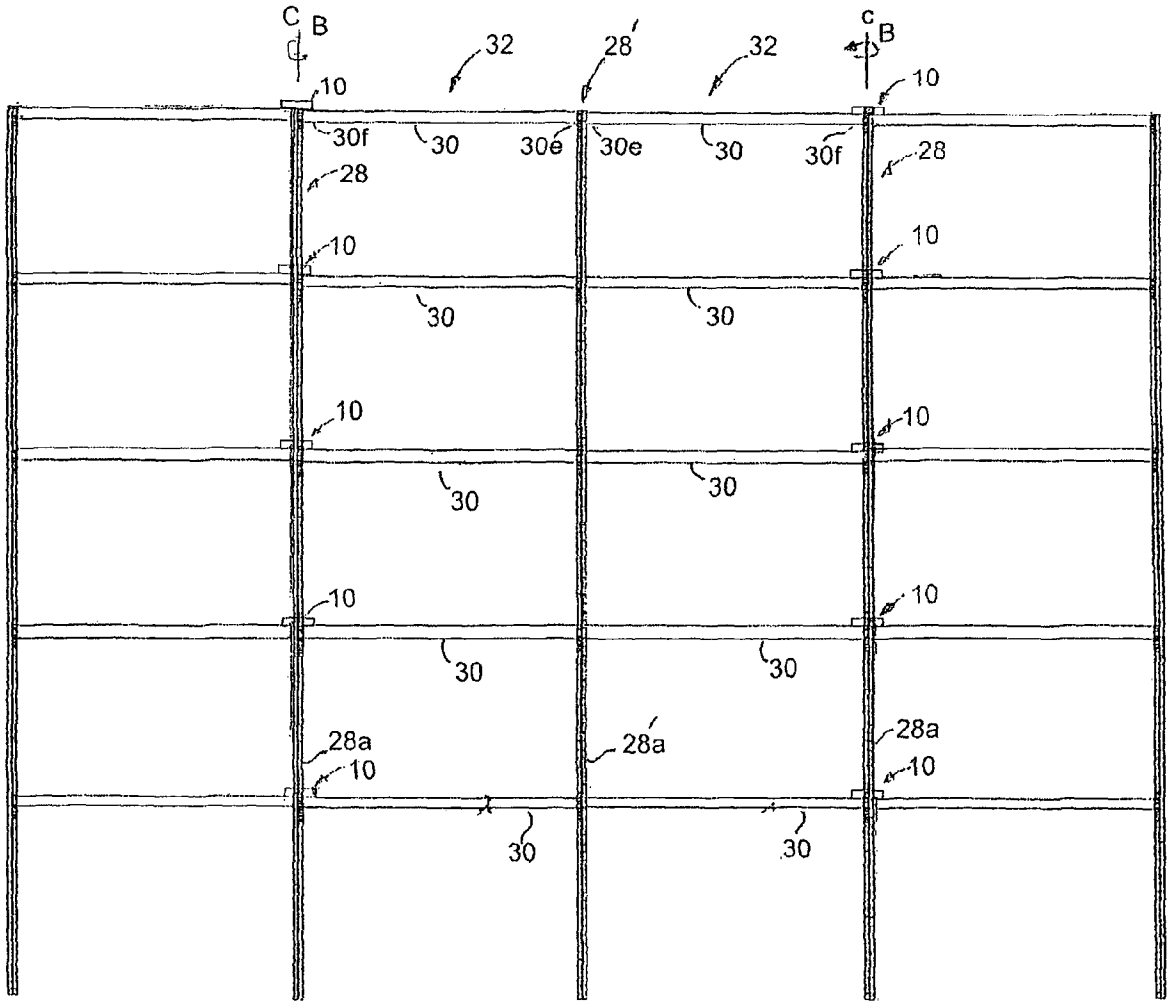
FIG. 8 is, in front elevation view, a portion of a racking system showing four rack sections mounted to one another on common uprights, wherein the center most upright is a damaged upright and wherein tools according to the present invention are mounted on adjacent uprights where they intersect their corresponding beams.
Figures 9A, 9B, 10:
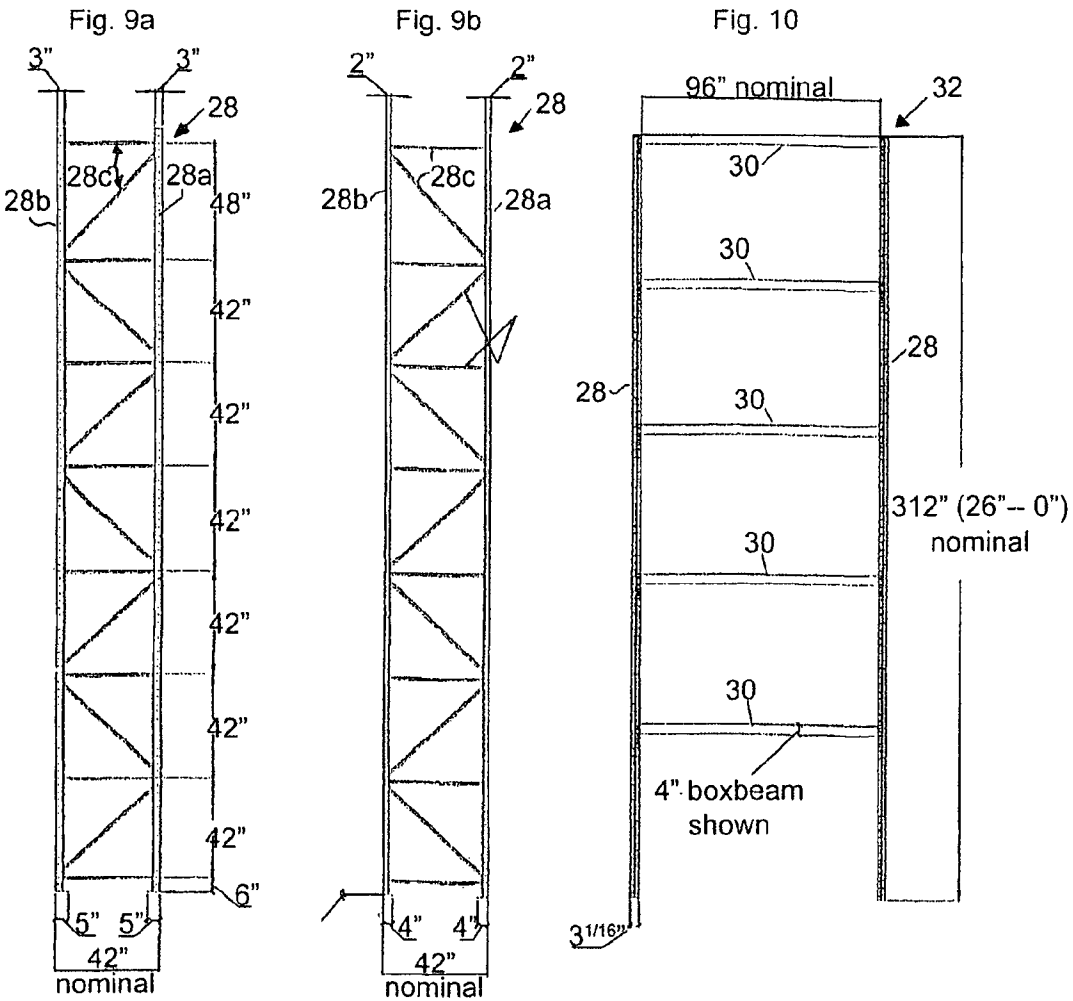
FIG. 9*a* is, in side elevation view, one form of upright which may be used in conjunction with the tool according to the present invention.
FIG. 9*b* is, in side elevation view, another form of upright which may be used with the tool according to the present invention.
FIG. 10 is a single section of racking as used in the racking system of FIG. 8.
Figure 11:
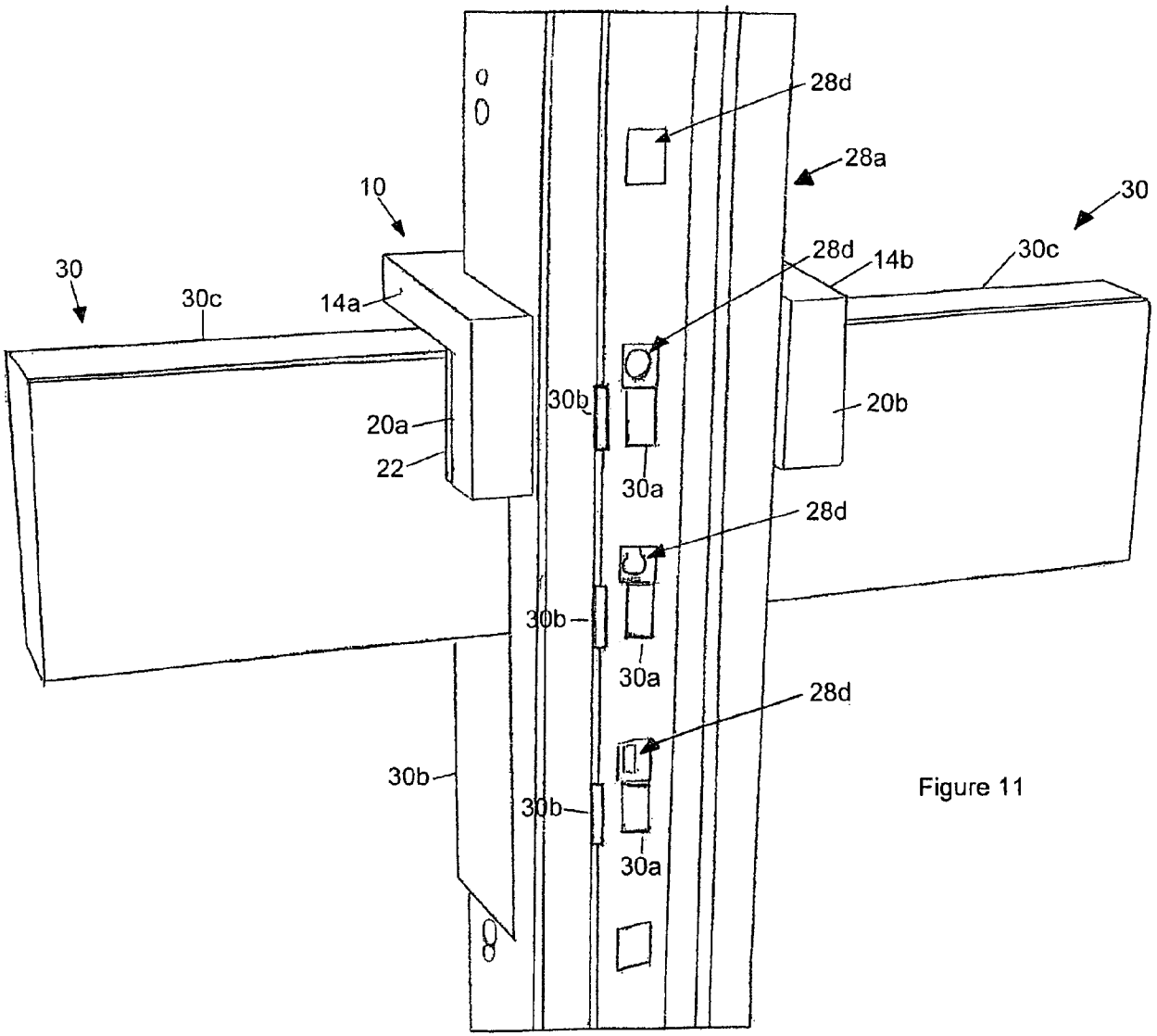
FIG. 11 is, in partially cut-away top rear perspective view, two cross beams mounted to a front member of an upright wherein a tool according to the present invention has been mounted around the front of the upright and hooked over the cross beams.
Figure 12:
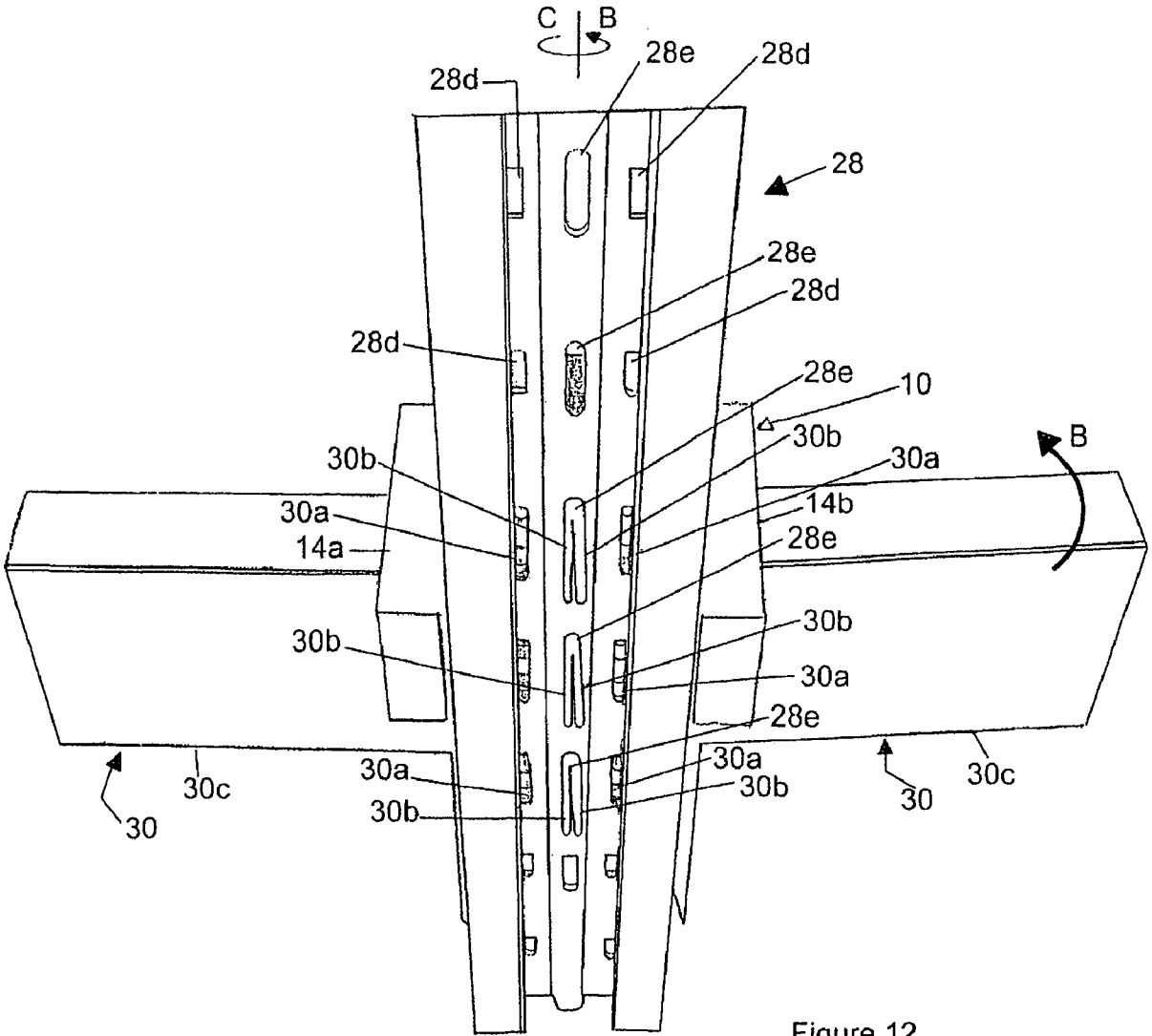
FIG. 12 is a partially cut-away top rear perspective view of the upright and cross beam junction of FIG. 11 showing the outward rotation of one of the cross beams relative to the upright so as to swing the opposite end of the cross beam away from the next adjacent upright so as to allow replacement of the next adjacent upright.
Figure 13:
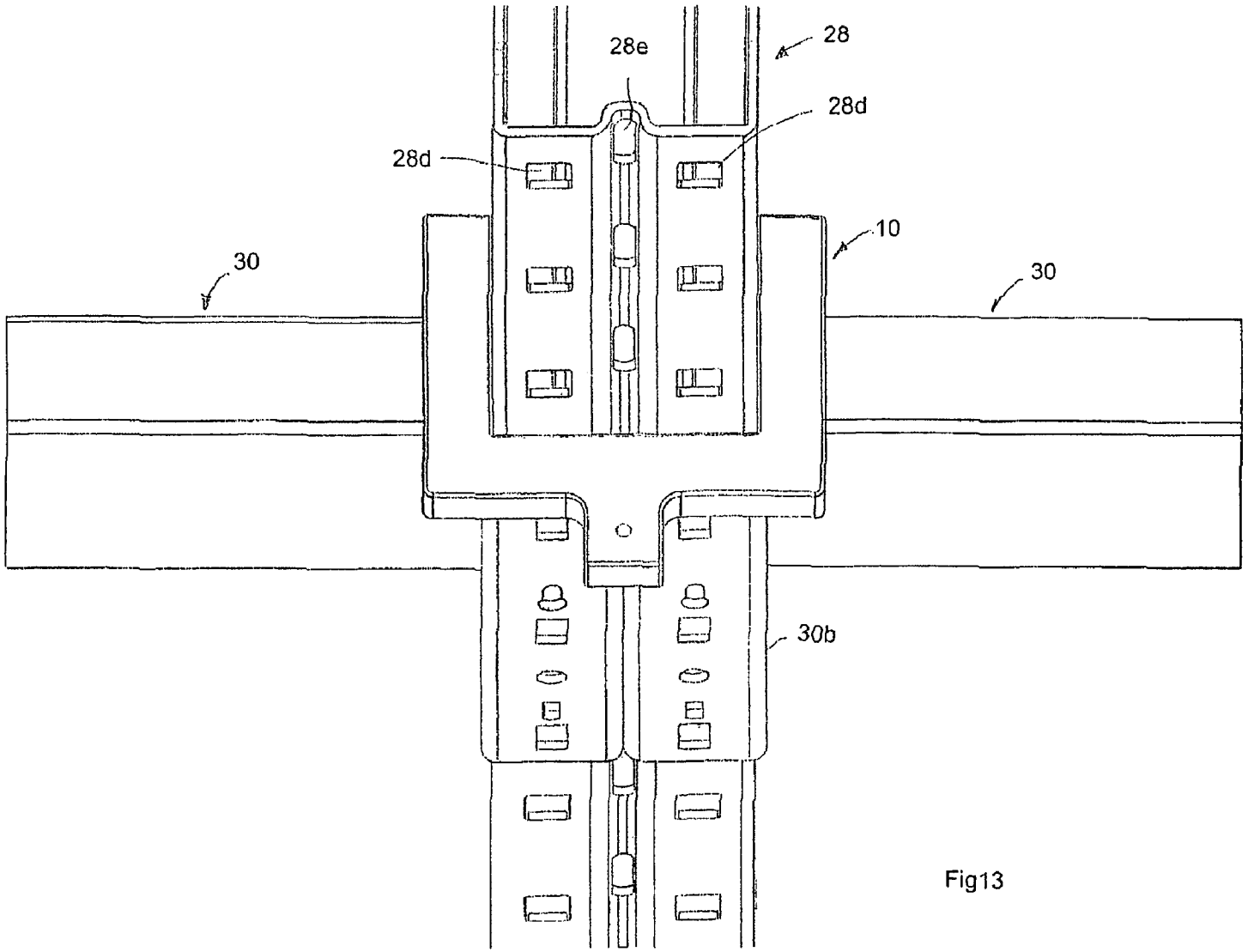
FIG. 13 is, in top front perspective view, the cross beam and upright junction of FIG. 11.
Figure 14:
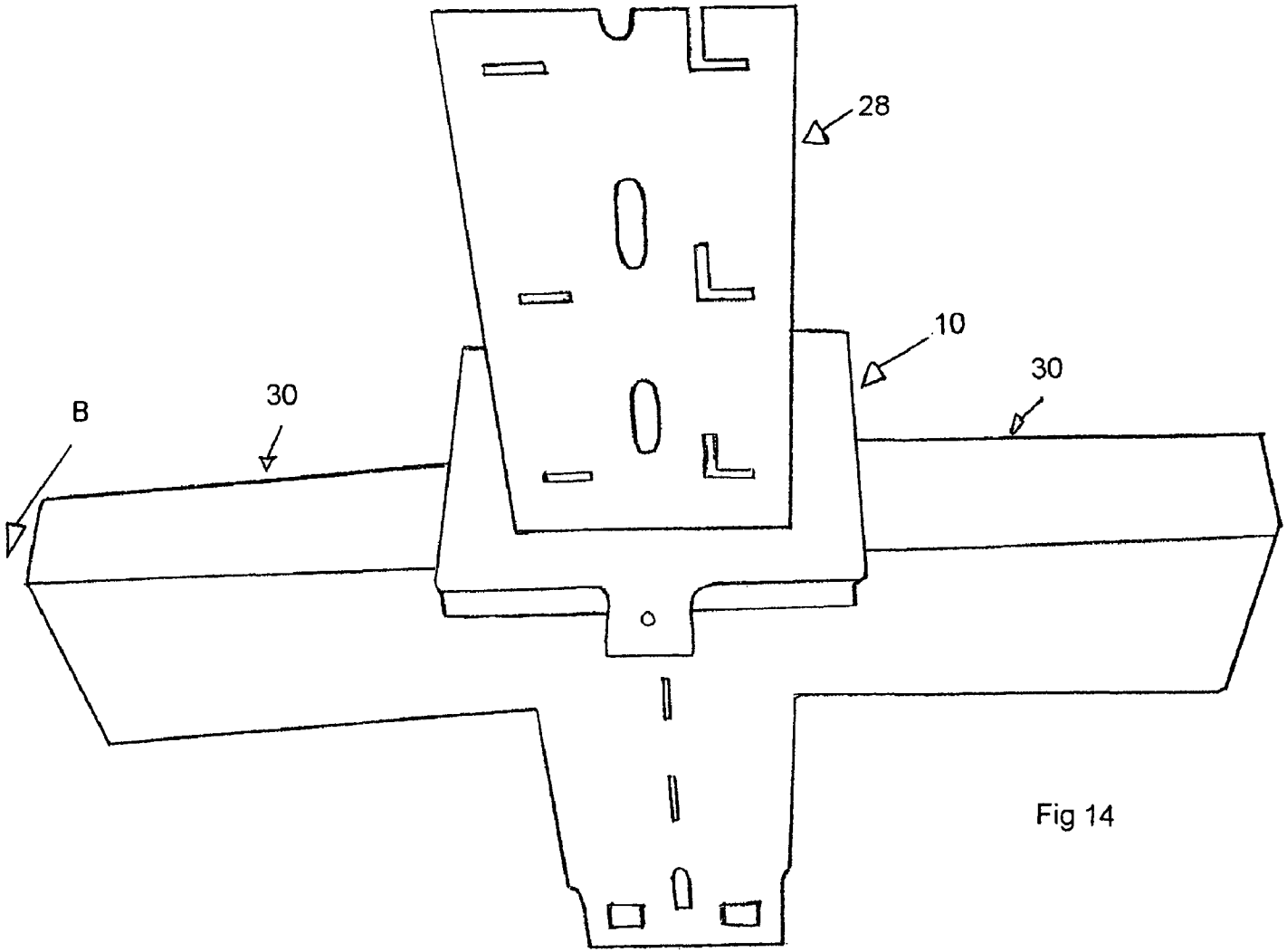
FIG. 14 is, in partially cut away top front perspective view, the cross beam and upright junction of FIG. 12.
Figure 15:
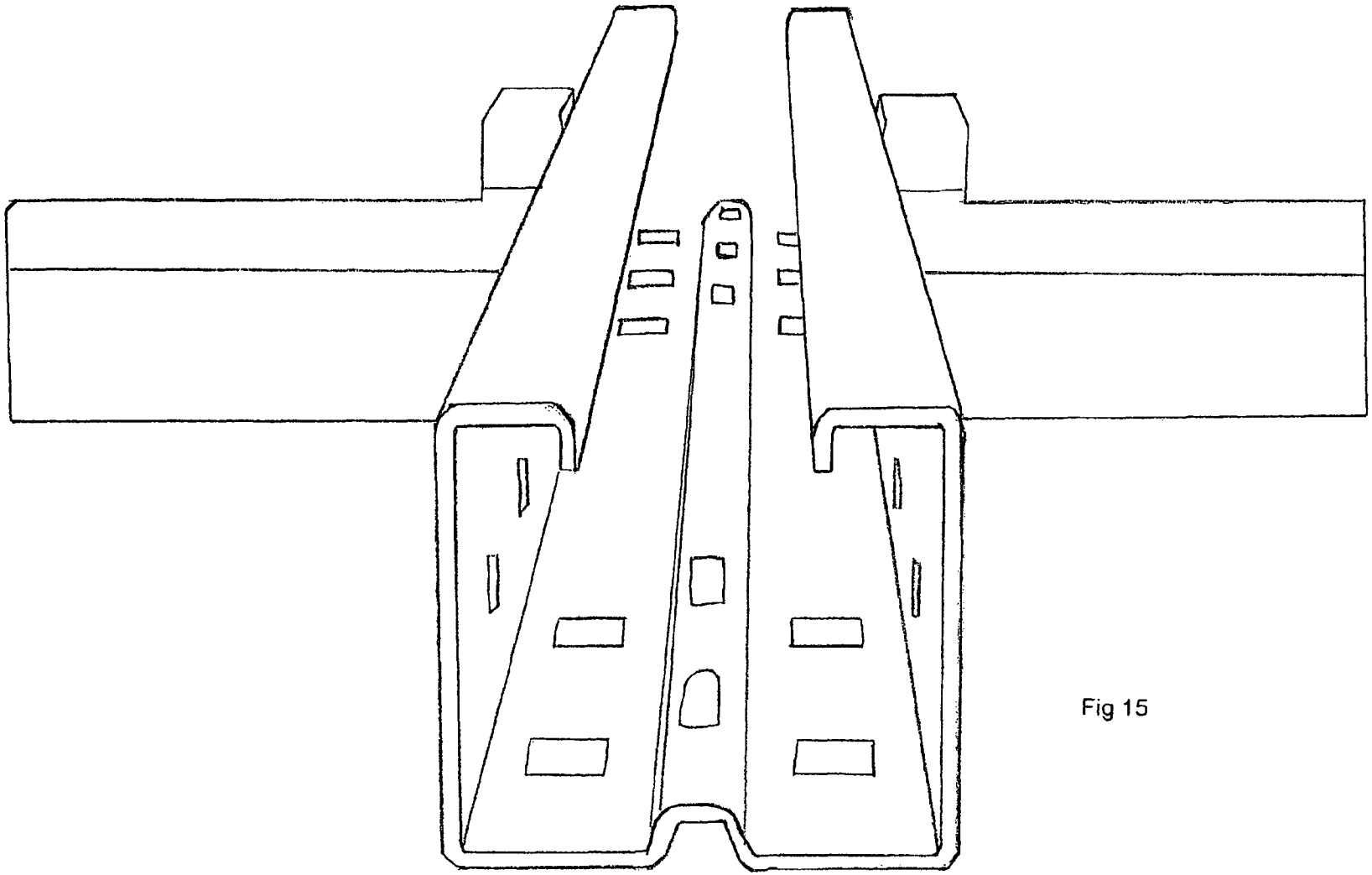
FIG. 15 is, in bottom rear perspective view, the cross beam and upright junction of FIG. 11.
Figure 16:
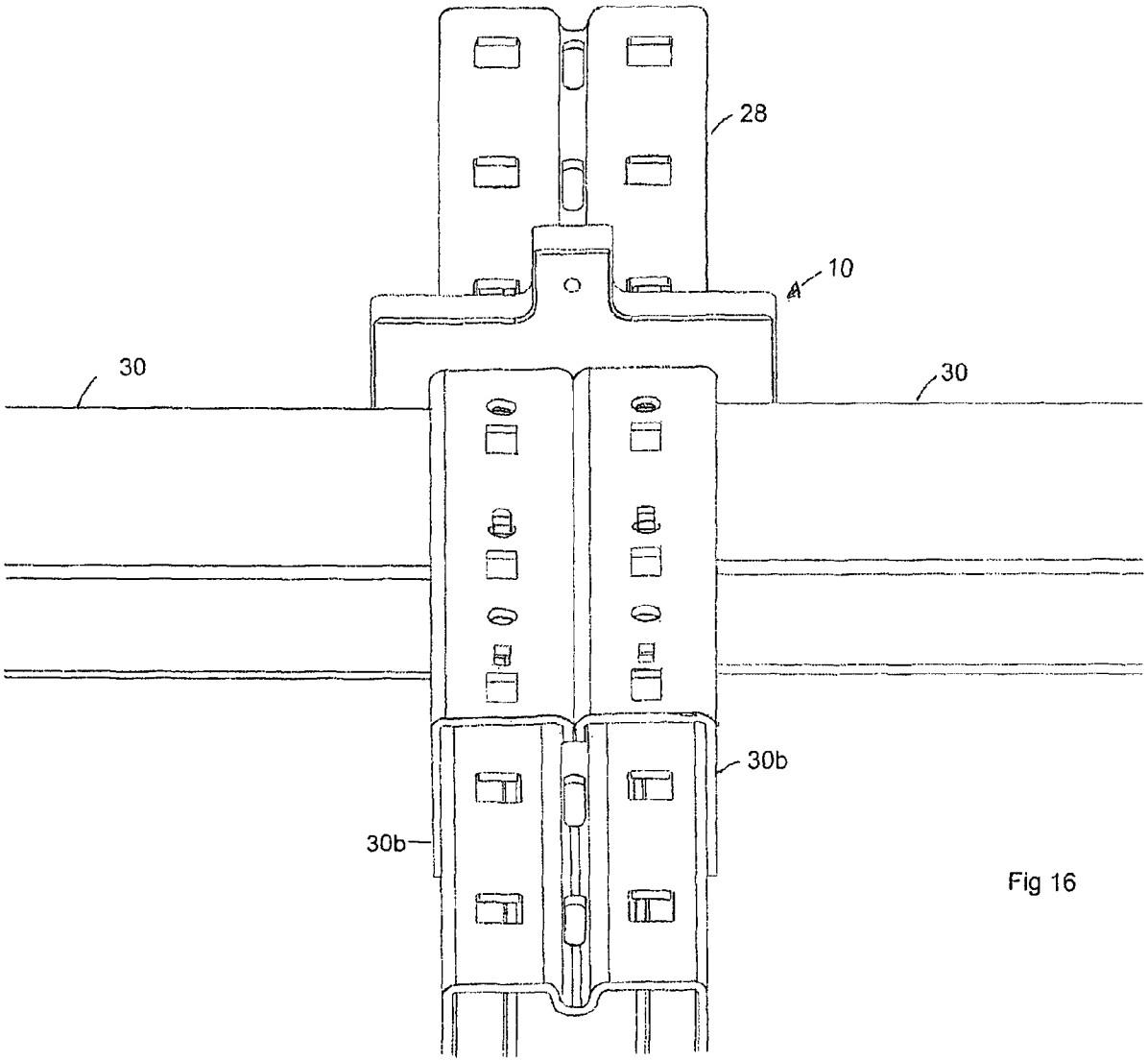
FIG. 16 is, in partially cut away bottom front perspective view, the cross beam and upright junction of FIG. 12.

A section of a pallet racking system is shown in FIG. 8. Uprights 28 support beams 30. Two different versions of uprights 28 are illustrated in FIGS. 9*a* and 9*b*, respectively being an EF313 frame and EF214 frame as would be known to one skilled in the art. Each upright 28 includes a front member 28*a* and a parallel rear member 28*b* mounted to one another by cross bracing 28*c* so as to form the vertical truss of each upright 28. Each upright 28 extends from front to back of each racking section 32. In FIG. 8 four rack sections 32 are formed side-by-side by mounting beams 30 on their common uprights 28. It is understood that although four rack sections 32 are illustrated in FIG. 8, that a racking system may employ many more such rack sections 32 mounted to each other in side-by-side array.

As it would be known to one skilled in the art, within rack sections 32, front beams 30 mount onto front members 28*a* and parallel rear beams 30 mount onto rear members 28*b* by latching hooked tangs 30*a* into corresponding tang-receiving apertures 28*d* in front and rear members 28*a* and 28*b*. Tangs 30*a* extend downwardly from beam flanges 30*b* so as to align in a linear array with the corresponding linear array of apertures 28*d* extending vertically along the front and rear members 28*a* and 28*b*. Flanges 30*b* are rigidly mounted to the ends of beam cross members 30*c*. Interior edges 30*b*' of flanges 30*b* are formed as downwardly projecting hooks also hook into vertically aligned slots in a vertically aligned channel 28*a*' formed medially along the front face of front member 28*a*, rear member 28*b* having a corresponding array of slots formed in a corresponding channel also. Typically each interior edge 30*b*' may be formed as two or three downwardly projecting hooks, each aligned one over the other.

In the situation where for example the front member 28*a*' of upright 28' becomes damaged for example by a forklift driving into its lowermost end, upright 28' may then be replaced by the use of tool 10 according to the following procedure.

Tools 10 are mounted on the junctions between beams 30 and uprights 28 on the uprights 28 on either side of upright 28', that is, on either side of the damaged upright. Tools 10 are mounted so that hook members 20*a* and 20*b* are hooked behind cross beams 30*c* and so that base member 16 of tool 10 thereby snuggly crosses horizontally flush across flanges 30*b*. This is accomplished by mounting collar 12 in direction A so as to surround front member 28*a* on the front of upright 28 and so as to surround rear member 28*b* on the rear of upright 28 and so as to thereby rest collar 12 down onto the upper most edges of flanges 30*b*. With the collar 12 thus mounted snuggly and securely around the front and rear members 28*a* and 28*b* respectively, of the upright 28, and with the corresponding hook members 20*a* and 20*b* hooked behind the cross beams 30*c*, tangs 30*a* for the beams 30 adjacent upright 28' may be removed from the apertures 28*d* both on the upright 28*a*' and also on the adjacent uprights 28*a*. Thus once the hooks 30*b*' are unhooked from the damaged upright 28', beams 30 are then free to hinge on the adjacent uprights 28 so as to rotate in direction B while only hanging by hooks 30*b*'. Beams 30 are free to rotate slightly in direction B by the pivoting of hooks 30*b*' in their corresponding apertures 28*e* (seen in FIG. 8). The rotating of the adjacent beams 30 on either side of upright 28' is illustrated by counter-rotating arrows B about vertical axis of rotation C extending through front members 28*a* of both uprights 28 adjacent the damaged upright 28'.

As beams 30 pivot in direction B, ends 30*e* of the beams, that is, the ends of the beams contacting damaged upright 28', swing a small distance so as to be free of the damaged upright. A small resilient outward-swinging pressure applied to the opposite ends 30*f* of the beams by bumpers 22 maintains the ends 30*e* free of the damaged upright 28'. Thus as beams 30 rotate in direction B relative to front members 28*a* and rear members 28*b*, the ends of beams 30 which have been disconnected from the damaged upright 28' are free to swing slightly forwardly and away from the damaged upright 28' thereby allowing the workers to then move to the next level of beams 30 to be disconnected from damaged upright 28'. The procedure is then repeated for each level of beams 30 in the racking system. That is, tool 10 is hook onto the junction between beams 30 and the adjacent uprights 28 then corresponding beams 30 are disconnected from the damaged upright 28', and so on until all of the beams 30 are disconnected from the damaged upright 28' and rotated away from the damaged upright 28' so that the damaged upright 28' can be removed and replaced with an undamaged one. Once the new undamaged upright 28 has been substituted, beams 30 may be then re-attached to the new upright, and once reattached, so that each beam 30 is then properly attached to the uprights 28 on either end of beams 30, then tools 10 may be removed.

As will be apparent to those skilled in the art in the light of the foregoing disclosure, many alterations and modifications are possible in the practice of this invention without departing from the spirit or scope thereof.

What is claimed is:

1. A method for disassembling a racking system so as to remove a damaged upright or adjust an upright wherein the racking system includes an array of laterally spaced apart vertical uprights supporting interleaved therebetween horizontal rows of cross beams, and wherein the cross beams are mounted to the uprights by hooks on the end of the cross beams mating down into corresponding apertures in the uprights, the method comprising the steps of:

a) providing a rack disassembly tool comprising:

a substantially planar U-shaped collar having a pair of legs extending from a base, said pair of legs having distal ends distal to said base, a pair of hook members depending downwardly from said distal ends of said pair of legs, a pair of resilient pads mounted in a pair of elbows formed at junctions between said pair of legs and said pair of hook members, b) mounting one of said tools at each junction of a cross beam and an upright on each upright of a pair of uprights on either side of the upright to be removed or adjusted by hooking said pair of hooked members behind said cross beam with said pair of legs straddling said upright and so as to cross said base horizontally snugly across said upright and with said resilient pads sandwiched between said pair of hooked members and the corresponding cross beams;

c) un-hooking the cross beams from the upright to be removed or adjusted and allowing the cross beams to pivot about the uprights on either side thereof so as to swing the cross beams outwardly of the racking system, thereby allowing access to the upright to be removed or adjusted, wherein the swinging of the cross beams is under the resilient outwardly urging of said resilient pads acting on the cross beams;

d) replacing or adjusting the upright once disconnected from and between the ends of the outwardly pivoting cross beams.

* * * * *